United States Patent [19]

Wright et al.

[11] Patent Number: 4,505,696

[45] Date of Patent: Mar. 19, 1985

[54] METHOD OF ERECTING A COMPLIANCE CARRIER

[75] Inventors: William H. Wright, Cincinnati, Ohio; John M. Kruse, Newport, Ky.

[73] Assignee: The C.W. Zumbiel Co., Cincinnati, Ohio

[21] Appl. No.: 282,035

[22] Filed: Jul. 10, 1981

Related U.S. Application Data

[62] Division of Ser. No. 134,959, Mar. 28, 1980, Pat. No. 4,319,682.

[51] Int. Cl.[3] ..... B31B 7/26

[52] U.S. Cl. ..... 493/130; 493/92; 493/912; 493/151

[58] Field of Search ..... 493/130, 138, 90–92, 493/904, 906, 912, 151; 229/52 BC; 206/187, 188, 196, 200

[56] References Cited

U.S. PATENT DOCUMENTS

| | | | |
|---|---|---|---|
| Re. 23,871 | 9/1954 | Castle . | |
| 2,460,229 | 1/1949 | Lebold . | |
| 2,778,526 | 1/1957 | Forrer . | |
| 2,835,408 | 5/1958 | Armeson . | |
| 3,093,265 | 6/1963 | Armeson . | |
| 3,104,027 | 9/1963 | Kulig . | |
| 3,125,243 | 3/1964 | Armeson . | |
| 3,168,311 | 2/1965 | Petter . | |
| 3,208,632 | 9/1965 | Graser . | |
| 3,208,633 | 9/1965 | Graser . | |
| 3,211,357 | 10/1965 | Weiss . | |
| 3,416,653 | 12/1968 | Farquhar | 493/91 X |
| 3,576,274 | 4/1971 | Stramaglia | 493/90 X |
| 4,029,205 | 6/1977 | Wood | 206/188 X |

*Primary Examiner*—James F. Coan

*Attorney, Agent, or Firm*—Wood, Herron & Evans

[57] ABSTRACT

A compliance carrier of the basket type having a row of cells on each side of the center handle panel. Each row's cell divider panel section and cell compliance panel section are positioned and structured within the carrier blank so that the cell divider panels and cell compliance panels are glued together along a fold line oriented in the cross machine direction relative to the machine direction travel of the blank through a carton gluing machine, that fold line being a leading edge on the panel section not folded. Further, each row's cell divider panel section and cell compliance panel section are oriented and structured so that no glue tabs or panels within either section needs to be folded prior to gluing of the cell divider panels and cell compliance panels one to the other.

9 Claims, 12 Drawing Figures

METHOD OF ERECTING A COMPLIANCE CARRIER

This is a division of U.S. application Ser. No. 134,959, filed Mar. 28, 1980, now U.S. Pat. No. 4,319,682.

This invention relates to carriers. More particularly, this invention relates to basket style carriers.

There are, of course, innumerable different carrier structures known to the prior art. Carriers of the type with which this invention is associated are most commonly used in the beverage industry. Of the various types of carriers used in that industry, one of the most common types is known in the trade as a basket style carrier. The basket carrier includes opposed side walls, opposed end walls and a floor with partitions interiorly of the walls defining multiple cells. This style carrier commonly includes six or eight cells, the cells being provided in two side-by-side rows of three or four cells each. A handle panel is also provided parallel to and between the two rows to permit easy lifting and carrying of a fully loaded carrier by a consumer. In use, a beverage bottle is positioned within each open-top cell, and is supported within that cell by the carrier's floor. One typical basket type bottle carrier is commonly known as a six bottle carrier, and is used for marketing and carrying six relatively small, e.g., eight or twelve fluid ounce, beer bottles.

In the usual basket carrier, and in the beverage industry, the bottles are sized and configured to fit somewhat loosely within their respective cells. And, within each row the center bottle or bottles is separated from the end bottles by cell divider panels. Bottles in adjacent cells of a basket carrier normally have two contact points, i.e., two points at which a bottle in one cell will contact a bottle in an adjacent cell. These contact points are the shoulder and the heel of a bottle, and adjacent bottles therefore tend to contact adjacent bottles' shoulders and heels. Under normal handling circumstances, the thickness of the cell divider panel provides somewhat of a cushion between bottles in adjacent cells. But under more harsh handling circumstances, such as may occur when transporting bottle loaded basket carriers by railroad, the usual thickness paperboard from which basket carriers are fabricated does not provide a sufficient cushion. Bottle-to-bottle contact, even with a cell divider panel interposed therebetween, under harsh handling conditions can cause breaking of the bottle or chipping of the bottle which is, of course, undesirable from a marketing and safety standpoint.

Normally, basket style carriers in the beverage industry are made of paperboard having an 0.020 inch thickness. This 0.020 inch thickness paperboard is not thick enough to provide a suitable cushion between adjacent cells in a row of a basket carrier for railroad transportation purposes. Accordingly, the railroad industry has required that basket style carriers for beverage bottles be provided with cell divider panels having an 0.040 inch thickness for all bottle loaded basket carriers shipped by rail. In other words, and to meet compliance with the railroads' regulations, a beverage bottler or producer must, when bottles are shipped in a basket style carrier, provide cell divider panels of 0.040 inch thickness at least at the shoulder and heel contact points of bottles in adjacent cells. This type basket carrier is known as a compliance carrier, and it is to this type carrier that this invention is directed.

There are two different types of compliance carriers known to the basket carrier art. This first type is an insert style carrier in which the basic carrier configuration, i.e., the end walls, side walls, and floor, is made of 0.020 inch thick paperboard, but in which the cell divider panels are made of 0.040 inch thick paperboard. The separate cell divider panels of thicker board are glued in place with the carrier's side panels, or are mechanically latched in place with the carrier's side wall panels upon fabrication of the carrier. In other words, and in this so-called insert style of compliance carrier, separate compliance insert panels are provided from a thicker paperboard than the paperboard used to fabricate the basic carrier configuration or basket, the insert panels being separately attached to the carrier basket structure.

The second type of compliance carrier known to the prior art is fabricated from a one-piece carrier blank. In this second style, the carrier blank is made of 0.020 inch thick paperbaord, and the blank's panels are structured so as to provide double thickness cell divider panels through use of fold-over or compliance panels at the shoulder and heel contact points of adjacent bottles in adjacent cells. This one-piece blank style is, of course, desirable in that no separate insert pieces need be made, and no separate insert pieces need be individually glued or latched to the carrier basket, as is the case with the insert style compliance carrier. However, the prior art one-piece blank types of compliance carrier provide problems during fabrication of the carrier blank into a folded and glued carrier in knock-down configuration. These problems are primarily due to the structure of the compliance carrier blank, and occur as the blank is being folded and glued on a carton gluing machine. Prior art one-piece blanks of compliance carriers are always structured, to the best of my knowledge, so that, as the blank passes through the carton gluing machine, at least one of the folds made by the cell divider panel sections and cell compliance panel sections, and/or made by cell divider panels and cell compliance panels within one of those sections, is made along a fold line parallel to the machine direction of the blank through the machine. Folding a panel or flap or section of a one-piece blank parallel to the machine direction of the blank as the blank passes through the carton gluing machine is more difficult to control than folding the same portion in a cross machine direction. Further, and perhaps more importantly, all one-piece compliance carrier blanks of the prior art of which I am aware require, during folding and gluing of the blank into an assembled carrier, the folding of at least one glue tab, or at least one panel within at least one of the cell divider panel sections and the cell compliance panel sections, prior to folding and gluing that panel section in place relative to its assembled position with its related side wall panel. In this connection, the folds required to achieve final assembled position of the cell divider panels and cell compliance panels relative one to another within the assembled carrier are compound folds in that at least two fold lines, i.e., at least two separate folds, are required within a given row's cells to get the final construction of cell compliance panel and cell divider panel. These prior art one-piece compliance carrier blanks, with attendant structural features noted, also provide a couple of problems when it is attempted to assemble the blank through use of a currently known carton gluing machine. In the first instance, and when a glue flap or panel must be first folded back relative to a blank's section before that section is folded into final assembled relation, and while making the second or final fold for the section, the first folded flap or panel tends to pop open. This results in smearing of glue on the blank handling structure of the carton gluing machine, which in turn results in smearing of glue on other areas of the carrier blank where glue is not desired. This, in turn, results in an improperly glued or assembled carrier since the popped open flap or panel will be glued in place, but that place will be an incorrect location relative to the carrier structure which, of course, results in an improperly assembled compliance carrier. In the second place, glue picked up by the carton gluing machine from the popped open flat of a preceeding blank may be deposited on one or more succeeding blanks in incorrect locations, thereby compounding the number of defective carriers produced by the machine. Further, and importantly, the carton gluing machine itself must run at a relatively slow speed because of the necessity to make the compound or double folds, thereby providing less output than is desirable from a production throughput standpoint.

Therefore, it has been one objective of this invention to provide a carrier blank for a compliance carrier, and a method of assembling same, in which the cell divider panel and the cell compliance panel sections for each row of cells are glued one to another simply by folding one of those panel sections along a cross machine direction fold line that is a leading edge of the non-folded section relative to the machine direction of the blank through a carton gluing machine.

It has been another objective of this invention to provide a carrier blank for a compliance style basket carrier in which none of the glue tabs or panels within each cell divider panel section, or within each cell compliance panel section, are folded back within that section prior to the folding and gluing of that section with its related section of the carrier blank as the blank passes through a carton gluing machine.

A single or one-piece carrier blank for a basket type compliance carrier so fabricated is a relatively simple blank to fold and glue through use of known carton gluing machines. A compliance carrier blank so structured prevents glue from being smeared on the machine parts as the blank passes through the machine which, if same occurred, might cause that blank, and/or the next blank through, to pick up glue in the wrong spot and cause a malproduced carrier. Further, this prevents any glue tabs and/or panels within each cell divider panel section and each cell compliance panel section of the blank from requiring a fold back step prior to being glued in place, which prior folded back tab and/or panel, upon passing through the carton gluing machine, might release or pop open to cause gluing of the panel or tab in the wrong place in the assembled carrier, thereby also causing an incorrectly assembled carrier.

Other objectives and advantages of this invention will be more apparent from the following detailed description taken in conjunction with the drawings in which:

FIG. 7 is a view similar to FIG. 1 but illustrating a second embodiment of a compliance carrier assembled in accord with the principles of this invention, and in erected or set-up configuration;

Figure 1:
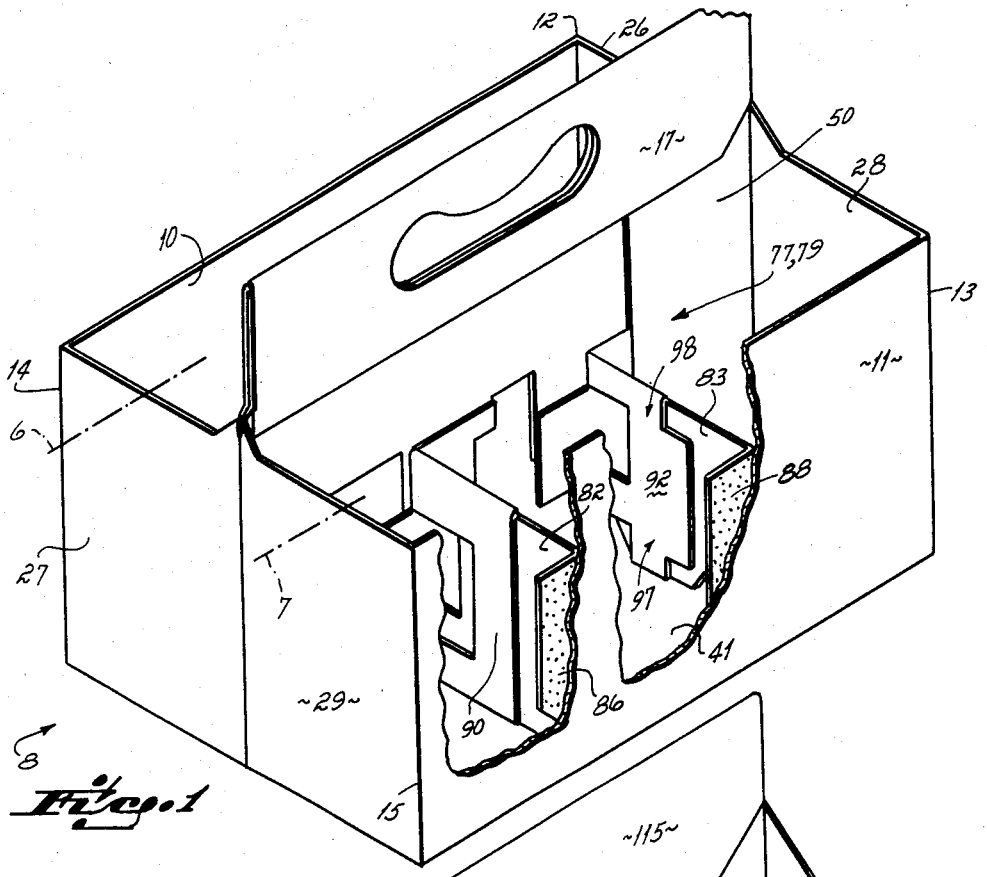
FIG. 1 is a partially cut away perspective view illustrating a first embodiment of a compliance carrier assembled in accord with the principles of this invention, and in erected or set-up configuration.
Figure 2:
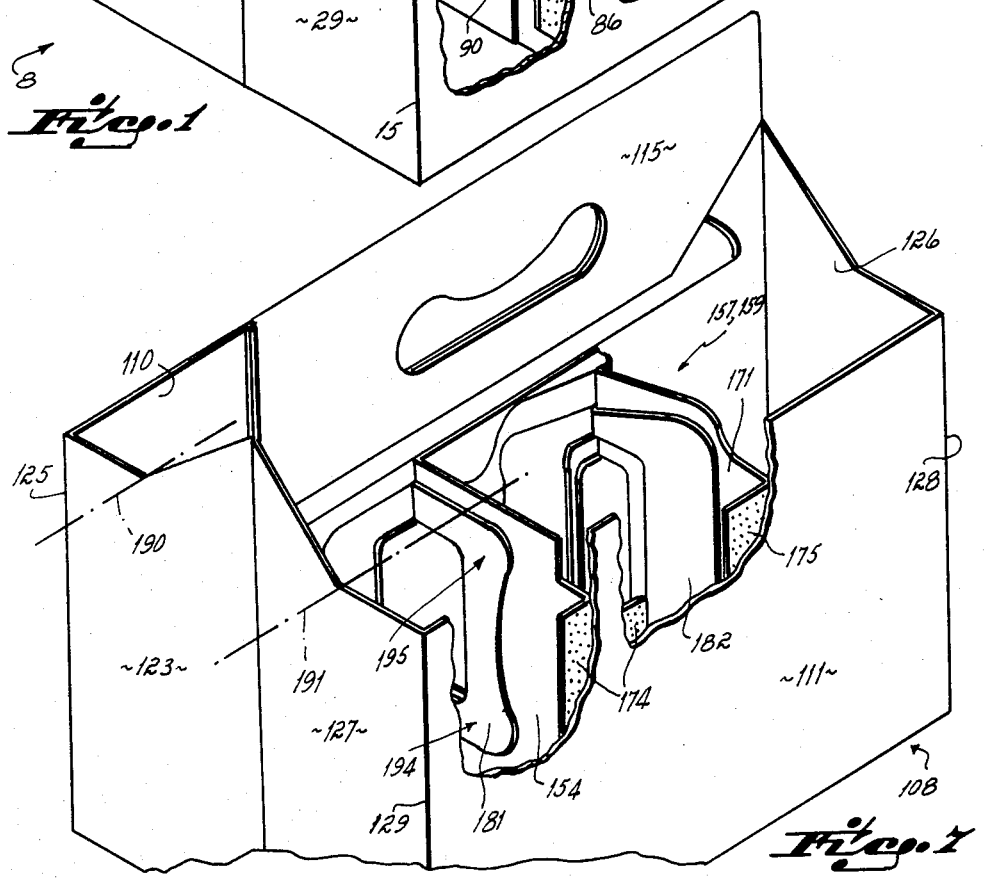
FIG. 2 is a top view of a carrier blank for the compliance carrier of FIG. 1, the blank being shown in as-cut form.
Figure 2:
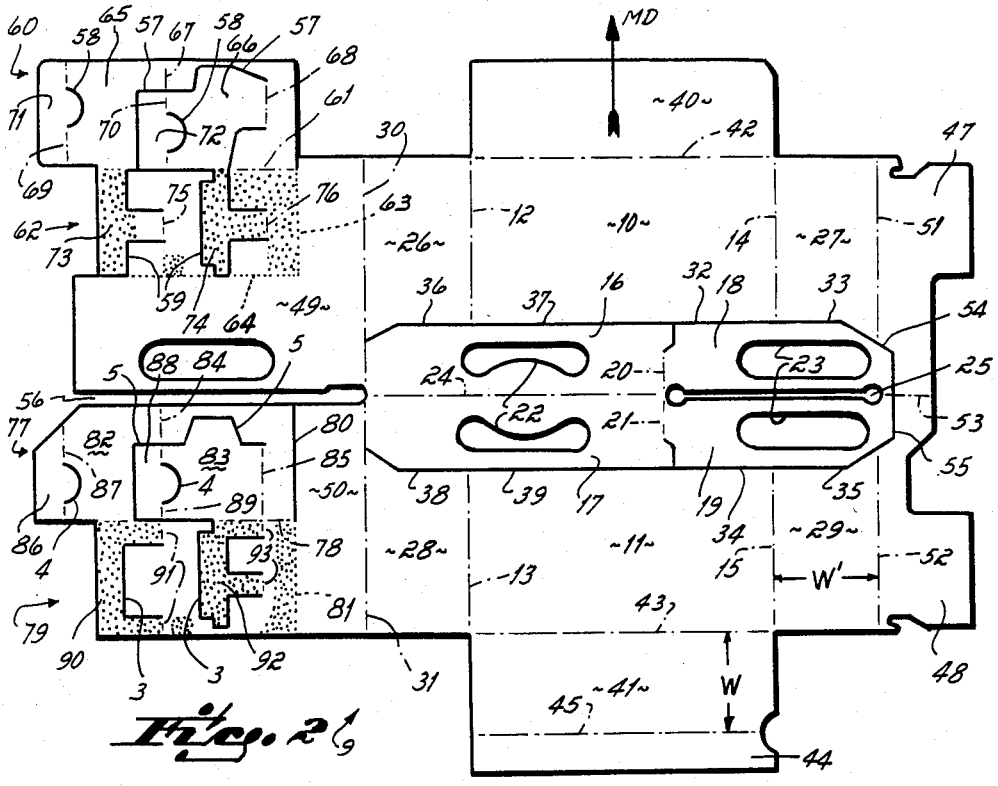

A first preferred compliance carrier 8 in accord with the principles of this invention is illustrated in FIG. 1 in erected or set-up configuration, and in FIG. 2 in carrier blank 9 configuration. Assembly of the compliance carrier 8 from the carrier blank 9 configuration shown in FIG. 2 into the assembled but knock-down carrier configuration shown in FIG. 6 is illustrated in sequence in FIGS. 2–5.

The carrier blank 9 of the first embodiment includes side wall panels 10, 11 having respective pairs 12, 13, and 14, 15 of side edges in linear relation one with another. The side panels 10, 11 are separated by handle panels 16, 17 and handle reinforcing panels 18, 19, handle panel 16 being foldably connected to handle reinforcing panel 18 along fold line 20 and handle panel 17 being foldably connected to handle reinforcing panel 19 on fold line 21. Each of the handle panels 16, 17 and each of the handle reinforcing panels 18, 19 is provided with hand cut-outs 22, 23 respectively, adapted to overlie one another (see FIG. 3) for access by the carrier's user when the blank 9 is assembled and the carrier 8 is erected. Note the two handle panels 16, 17 are foldably connected one to another by longitudinal fold line 24, but the two handle reinforcing panels 18, 19 are separated one from another by slot 25 aligned with the fold line 24 to permit easy folding of those panels 16–19 during assembly of the carrier blank.

The carrier blank 9 also includes pairs 26, 27 and 28, 29 of end wall panels that are connected to respective side wall panels 10 and 11. The end wall panels 26, 27 define the end walls of one row 6 of cells in the erected carrier, and the end wall panels 28, 29 define the end walls of the other cell row 7 in the erected carrier, the end wall panels 26, 28 and 27, 29 thereby respectively defining the end walls of the carrier. Note the end wall panels 26, 27 are foldably connected along fold lines 12, 14 to the side edges of the side wall panel 10, and the end wall panels 28, 29 are foldably connected along fold lines 13, 15 to the side wall panel 11. Note further that the handle panels 16, 17 are foldably connected along fold lines 30, 31 to the end wall panels 26, 28. The handle reinforcing panels 18, 19 are therefore foldably connected to the handle panels 16, 17 by fold line 20, 21, and are separated from the side wall panels 10, 11 and end wall panels 27, 29 by cut-lines 32–35. Further, the handle panels 16, 17 are foldably connected to the blank on fold lines 30, 31, but are separated from the end wall panels 26, 28 and side wall panels 10, 11 by cut-lines 36–39, respectively.

The carrier blank 9 further includes floor panels 40, 41 foldably connected to respective side wall panels 10, 11. The floor panel 40 is connected to side wall panel 10 along that panel's bottom edge fold line 42, and the floor panel 41 is connected to side wall panel 11 along that side wall panel's bottom edge fold line 43. Both floor panels 40, 41 are equal in width W to the width W' of the associated end wall panels 26–29. The floor panel 41 is foldably connected to glue flap 44 along fold line 45, that glue flap 44 cooperating with floor panel 40 to provide a contiguous floor 40, 41 when the carrier is in the erected FIG. 1 basket configuration. Since the carrier 8 in knock-down configuration, as well as in set-up configuration, is held together by gluing the two floor panels 40, 41 together through use of glue flap 44, this FIG. 1 compliance basket carrier is known as a glue bottom style type carrier. This contrasts with a glue handle style carrier where the carrier blank is glued together in the knock-down configuration through gluing the blank's handle panels together one with the other.

The compliance carrier is also provided with a center wall, when in erected configuration shown in FIG. 1, that is comprised of a series of keel panels 47–50. Two of the keel panels 47, 48 are foldably connected along fold lines 51, 52 to end wall panels 27, 29, respectively, thereby orienting those keel panels outboard of, and within the top 32, 34 and bottom 42, 43 edges of the side wall panels 10, 11, respectively. The two keel panels 47, 48 are foldably joined one to the other on fold line 53, and are separated from the respective handle reinforcing panels 18, 19 by cut-lines 54, 55. The keel panels 49, 50 cooperate with the keel panels 47, 48 to provide the center wall in the assembled compliance carrier when the blank 9 is glued together in assembled from. The keel panels 49, 50 are foldably connected on fold lines 30, 31, respectively, to the other end wall panels 26, 28. Further, the keel panels 49, 50 are foldably connected on that same fold line 30, 31 to the handle panels 16, 17. A slot 56 in the blank separates the two keel panels 49, 50 one to the other and lets them be foldable relative one to the other on their respective fold lines 30, 31. Importantly, and with respect to this invention, and as shown particularly in FIG. 2, for one row 6 of the compliance carrier, i.e., in association with one side wall panel 10 of the carrier blank, a cell divider panel section 60 is foldably connected on fold line 61 to a cell compliance panel section 62 that is, in effect, integral with the keel or center panel 49. The phantom outline of the cell compliance panel section 62 is illustrated by phantom lines 63, 64 which are neither fold lines nor cut lines. In the cell divider panel section 60, there is provided two cell divider panels 65, 66 cut from that section 60 (note cut lines 57) which are foldable relative to that section 60 on fold lines 67, 68 at side edges 67, 68 of those panels. Each of these cell divider panels 65, 66 is also foldably connected at its other side edge along fold lines 69, 70, respectively, to glue tabs 71, 72 (note cut lines 58). The associated cell compliance panel section 62 is comprised of cell compliance panels 73, 74 cut from the cell compliance panel section 62 (note cut lines 59) and foldably connected thereto along lines 75, 76, respectively. Those portions of the cell divider panel section 60 and cell compliance panel section 62 which do not comprise the cell divider panels 65, 66, nor cell compliance panels 73, 74, cooperate with the keel panel 49 to function as keel compliance panels for the carrier's center wall. Similarly, and in association with side wall panel 11 for the other row 7 of cells, there is provided a cell divider panel section 77 foldably connected on fold line 78 to cell compliance panel section 79. The cell divider panel section 77 is separable from keel panel 50 by cut line 80, and the cell compliance panel section 79 is, in effect, integral with that keel panel 59 but separate therefrom funtionally as illustrated by phantom line 81. The cell divider panel section 77 is comprised of cell divider panel 82 and cell divider panel 83 (note cut lines 5), cell divider panel 82 being foldable relative to the section 77 on fold line 84 and cell divider panel 83 being foldable relative to section 77 on fold line 85. The cell divider panel 82 is provided with glue tab 86 connected thereto on fold line 87 and cell divider panel 83 is provided with glue tab 88 (note cut lines 4) connected thereto on fold line 89. In the cell compliance panel section 79, cell compliance panel 90 is foldably connected to that section on fold line 91 and cell compliance panel 92 is foldably connected thereto on fold line 93, those panels being suitably cut from the section 79 on cut lines 3. With regard to the orientation of the various cell divider panels and their respective cell compliance panels, note that relative to the prospective machine direction (indicated by an arrow denoted MD) of the blank 9 through a carton gluing machine that each cell divider panel 65, 66, 82, 83 is provided in line with a cell compliance panel 73, 74, 90, 92, respectively, and that the folding of each cell divider panel section 62, 79 is on a fold line 61, 78, respectively, that is perpendicular to, i.e., in the cross machine direction relative to, the machine direction MD of the blank through the carton gluing machine, in order to achieve gluing of the cell divider panels to the cell compliance panels as is more particularly described in detail below.

In assembly or fabrication of the compliance carrier 8 from the blank 9 or as-cut configuration shown in FIG. 2 into the glued or knock-down configuration shown in FIG. 6, the blank is particularly adapted to pass through what is generally known to the trade as a right angle carton gluing machine. Initially, and as shown in FIG. 2, the blank is passed through the gluing machine in the machine direction (as shown by the MD arrow) with one side wall panel 10 preceeding the other side wall panel 11. The initial step is application of glue (as shown by the stippled area in FIG. 2) to the cell compliance panels 73, 74, 90, 92 and to limited areas within the remainder of cell compliance panel sections 62, 79. Subsequently, the cell divider panel sections 60, 77 are folded along what are leading fold lines 61, 78 (relative to the machine direction MD of the blank through the gluing machine) so that the cell divider panels 65, 66, 82, 83 are glued to the respective cell compliance panels 73, 74, 90, 92 and so that limited areas within each pair 60, 62 and 77, 79 of the cell divider panel and cell compliance sections are glued one to the other, the result of this first intermediate step being shown in FIG. 3. In connection with this folding and gluing step of the cell divider panels 65, 66, 82, 83 to the cell compliance panels 73, 74, 90, 92 associated with each side wall panel 10, 11 of the blank, there are a couple of important features of that panel structure which provide and permit the very simple folding and gluing step of the panel sections 60, 62 and 77, 79, respectively, relative one to the other. In the first instance, the fold line 61, 78 for each cell divider panel section 60, 77 with each cell compliance panel section 62, 79 in a cross machine direction, is a leading fold line, and only a single fold is required to glue the panel sections 60, 62 and 77, 79 (and, therefore, the cell divider panels and cell compliance panels therewithin) one to another in final glued configuration. Further, and importantly, there is no folding back of glue tabs or divider panels or compliance panels within any of the panel sections 60, 62, 77, 79 prior to the folding and gluing step of those sections illustrated between FIGS. 2 and 3. In this connection, note particularly there is no preliminary positioning required of any cell divider panel section or any cell compliance panel section, or any panels or glue tabs within those sections, relative one to the other prior to folding one of the sections into glued relation with the other of the sections for each side, i.e., each row 6, 7 of the carrier. Note further in this first embodiment that it is the cell divider panel sections 60, 77 which are folded perpendicular to the blank's machine direction MD through the carton gluing machine in order to glue the cell divider panels 65, 66 and 82, 83 to the cell compliance panels 73, 74 and 90, 92. Further, note all cell divider panels are folded and glued to all cell compliance panels prior to further folding and gluing of the blank 9 into cell row 6, 7 configuration, i.e., prior to folding and gluing the blank's end wall panels 26–29 and side wall panels 10, 11 into carrier 8 configuration. In this blank 9, also note that the cell divider panel sections 60, 77 and the cell compliance panel sections 62, 79, both extend from the same side of the respective side wall panels 10, 11 with which they are related.

Figure 3:
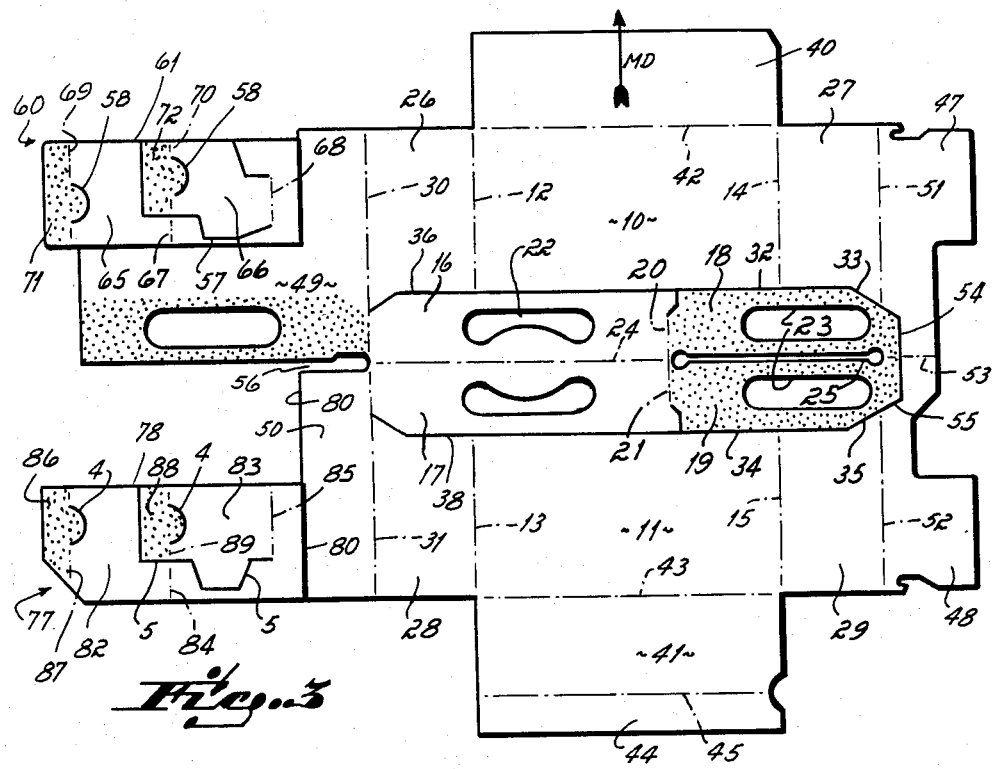
FIG. 3 is a view similar to FIG. 2 showing the blank's cell divider panel sections folded and glued to the blank's cell compliance panel sections in the first intermediate assembly step.
Figure 4:
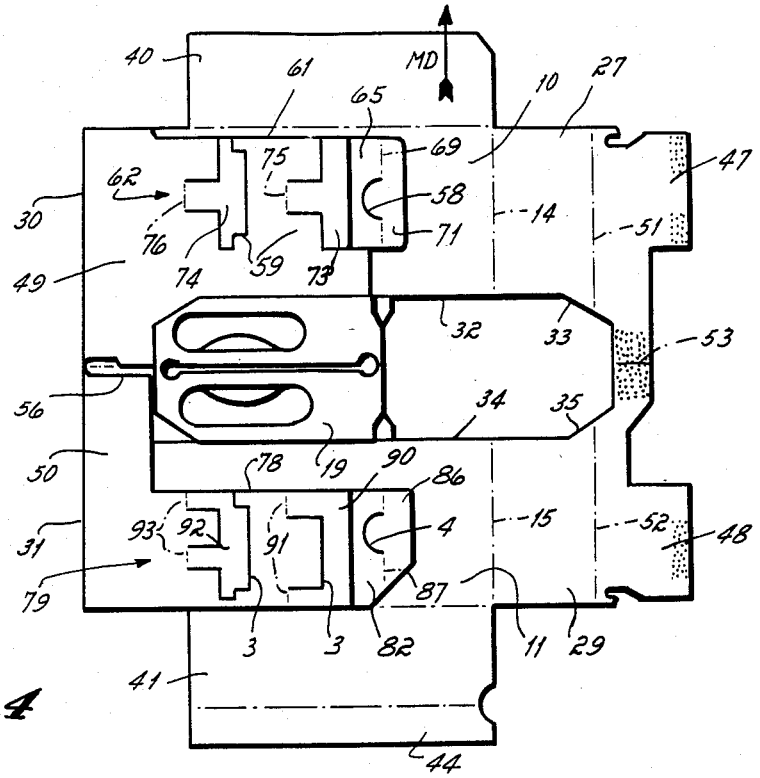
FIG. 4 is a view similar to FIG. 3 showing the blank's center panel sections, side wall panels, and handle panel sections folded and glued in a second intermediate assembly step.

With the carton blank 9 in the first intermediate folded and glued attitude shown in FIG. 3, additional glue is provided to the cell divider panel's glue flaps 71, 72, 86, 88, and glue is also applied to the handle reinforcing panels 18, 19, all as shown in the stippled areas in FIG. 3. Thereafter, the keel panels 49, 50 are folded on fold lines 30, 31 onto the side wall panels 10, 11, respectively, as shown in FIG. 4. Also, handle reinforcing panels 18, 19 are folded relative to fold lines 20, 21 so that those panels 18, 19 are glued onto keel panel 49 and handle panels 17, respectively, also as shown in FIG. 4. In this second intermediate folded and glued position shown in FIG. 4, the cell divider panels 65, 66 and 82, 83 are glued, through use of glue tabs 71, 72 and 86, 88, to their respective side wall panels 10, 11 so as to define the separate cells in each row 6, 7. Further in this second intermediate position shown in FIG. 4, the handle panels 16, 17 are glued at one end to the keel panels 49, 50. Note in this folding step from FIG. 3 to FIG. 4 that the machine direction MD of the blank through the gluing machine remains perpendicular to the top and bottom edges of the respective side wall panels 10, 11, as was the case when folding the blank 9 from the FIG. 2 to the FIG. 3 position. With the partially glued carton blank 9 in the FIG. 4 position, additional glue (as shown by the stippled areas in FIG. 4) is added to the keel panels 47, 48. Subsequently, the machine direction MD of the partially glued FIG. 4 blank is changed to a direction parallel to the top 37, 39 and bottom 42, 43 edges of the side wall panels 10, 11 as shown in FIG. 5, and the keel panels 47, 48 and end wall panels 27, 29 are folded on fold line 14, 15 so as to glue the handle area of the keel panels 47, 48 to the handle reinforcing panels 18, 19, and so as to glue the keel panels 47, 48 to the cell compliance panel sections 62, 79 which are not part of the cell compliance panels 73, 74 and 90, 92, respectively.

Figure 5:
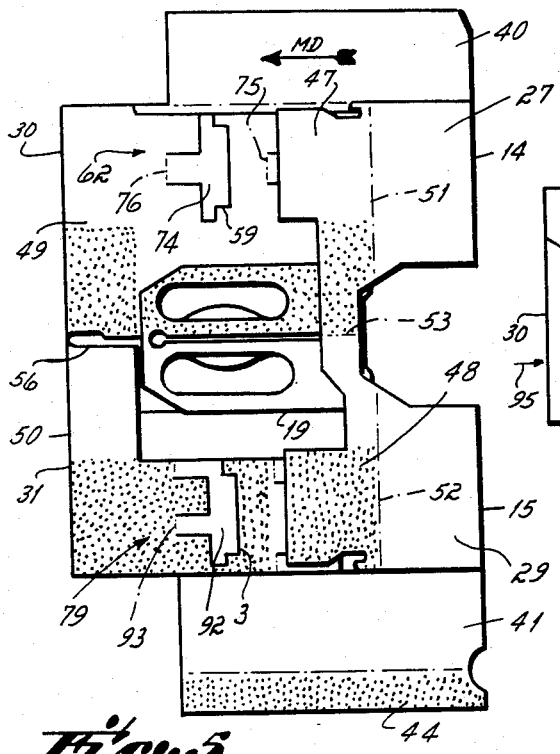
FIG. 5 is a view similar to FIG. 4 showing a third intermediate assembly step for the first carrier blank.
Figure 6:
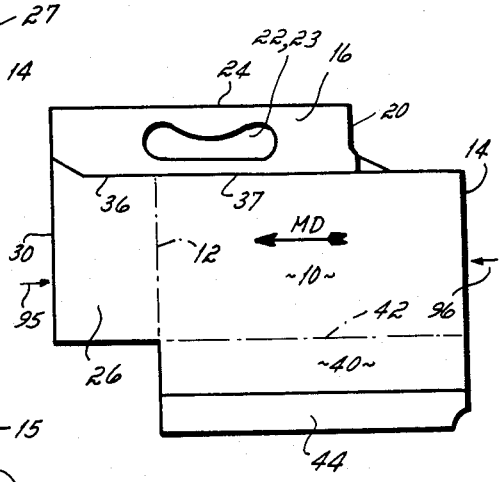
FIG. 6 is a view similar to FIG. 5 but showing the finally assembled carrier from the FIG. 2 carrier blank, the compliance carrier being shown in the knock-down configuration.

Thereafter, and with the third intermediate position of the partially glued and folded carrier blank as shown in FIG. 5, the handle panel section 18, the handle area part of keel panels 47, 49, all but the handle area parts of keel panels 48, 50, and that portion of the cell compliance panel section 79 not comprised of the cell compliance panels 90, 92 and glue tab 44, are all provided with additional glue, all as shown by the stippled areas in FIG. 5. With the FIG. 5 carrier traveling in the machine direction MD shown in that figure, one-half of the carrier is folded on top the other half of the carrier on fold line 53 to provide the final knock-down, but fully glued and assembled, carrier 8 configuration shown in FIG. 6. In the FIG. 6 configuration, and when opposite reactive forces 95, 96 are provided on end edges of the knock down carrier 8 structure, the carrier is erected into the set-up configuration shown in FIG. 1. The cut-away areas of the set-up basket carrier 8 of a compliance type, as shown in FIG. 1, illustrates the location of the carrier's cell divider panels vis-a-vis the cell compliance panels. In this connection, note particularly the double thickness cell divider panel (brought about through use of the cell compliance panels) which separates adjacent cells one from another in one cell row 7 of the carrier at both the heel location 97 and the shoulder location 98 of a bottle (not shown) to be received therein.

Figure 8:
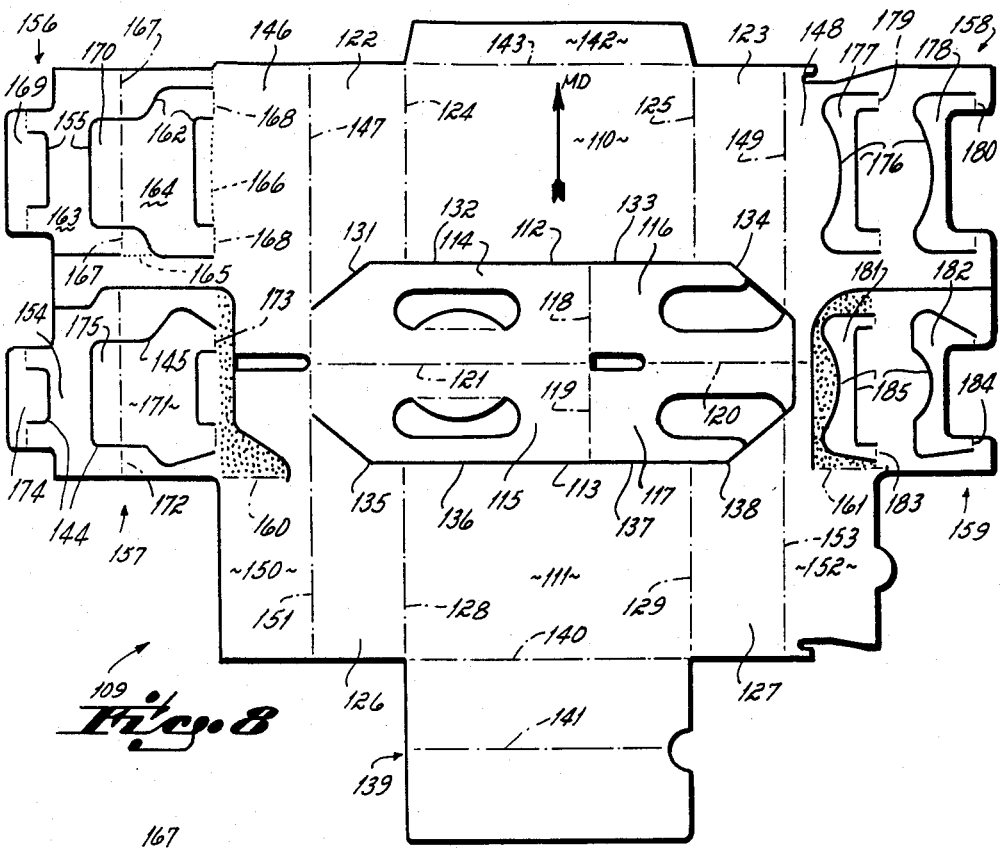
FIG. 8 is a top view of a carrier blank for the compliance carrier of FIG. 7, the blank being shown in as-cut form.

A second preferred embodiment of a compliance carrier 108 in accord with the principles of this invention is illustrated in erected or set-up configuration in FIG. 7 and in carrier blank 109 configuration in FIG. 8. Assembly of the carrier blank shown in FIG. 8 into a knocked-down but fully fabricated carrier shown in FIG. 12 is illustrated in the method step sequence shown in FIGS. 8–12.

The second blank 109 is comprised of side wall panels 110 and 111. The top edges 112, 113 of the side wall panels 110, 111 are separated or spaced one from the other, that space being taken up in the blank 109 by handle panels 114, 115, and by handle reinforcing panels 116, 117. The handle reinforcing panels 116, 117 are foldably connected to the handle panels 114, 115 along fold lines 118, 119, respectively, and are foldably connected one to another along fold line 120 parallel to the top edges 112, 113 of the side wall panels 110, 111. The handle panels 114, 115 are foldably connected along fold line 121 to one another, that fold line being coextensive with the handle reinforcing panel's fold line 120. End-wall panels 122, 123 are foldably connected by fold lines 124, 125, respectively, to each side edge of side wall panel 110. Similarly, end wall panels 126, 127 are foldably connected along fold lines 128, 129 to respective side edges of side wall panel 111. The handle panels 114, 115 and handle reinforcing panels 116, 117 are separated from the respective side wall panels and end wall panels by cut lines 131–138.

A floor panel 139 is foldably connected to the bottom edge of side wall panel 111 on fold line 140, the floor panel 139 being foldable on fold line 141 that is parallel to the associated side wall panel's bottom edge 140. A glue flap 142 is foldably connected on fold line 143 to the bottom edge of the other side wall panel 110. In this carrier blank 109 embodiment, a keel panel is foldably connected to the outboard edge of each end wall panel 122, 123, 126, 127. Specifically, keel panel 146 is foldably connected along fold line 147 to end wall panel 122, keel panel 148 is foldably connected along fold line 149 to end wall panel 123, keel panel 150 is foldably connected along fold line 151 to end wall panel 126, and keel panel 152 is foldably connected along fold line 153 to end wall panel 127. Note particularly these keel panel fold lines 147, 149, 150, 151, 153 are all perpendicular to the top 112, 113 and bottom 140, 143 edges of the side wall panels 110, 111. Also, note that there are two pairs of keel panels 146, 148 and 150, 152 associated with each side wall panel 110, 111, respectively, one of each respective keel panel pair being located outboard of each side edge 124, 125 and 128, 129 of the respective side wall panels. As shown in FIG. 8, the handle panels 114, 115 are foldably connected to the keel panels 146, 150 on fold lines 147, 151, this being the only foldable connection between the handle panels 114, 115, and the handle reinforcing panels 116, 117, with the carrier blank 109.

In this second carrier blank 109 embodiment, cell divider panel sections 156, 157 are located outboard of one side edge 124, 128 of the side wall panels 110, 111, and cell compliance panel sections 158, 159 are located outboard of the other side edge 125, 129 of the respective side wall panels 110, 111. In the case of the side wall panel 110, note that the cell divider panel section 156 and the cell compliance panel section 158 are located in line with the side wall panel 110, i.e., do not have to be pre-positioned prior to folding one on top the other (as shown in FIG. 11) to glue the panels within the cell compliance panel section to the panels within the cell divider panel section. However, the cell divider panel section 157 and the cell compliance panel section 159 associated with side wall panel 111 are foldably connected to the respective keel panels 150, 152 along fold lines 160, 161 that are parallel to the top 113 and bottom 140 edges of that side wall panel 111. This permits the cell divider panel section 157 and the cell compliance panel section 159 to be folded back into an in-line position where those sections are located outboard of the side wall panel 111 (compare FIG. 8 to FIG. 9) prior to gluing and folding of the cell compliance panel section 159 and the cell divider panel section 157 as shown in FIG. 11.

Specifically, and with reference to cell divider panel section 156, same is comprised of cell divider panels 163, 164 (note cut lines 162) which are part of the cell divider panel section 156 as defined by phantom lines 165, 166. The cell divider panels 163, 164 are foldably connected to that section 156, and to the keel panel 146, along fold lines 167, 168 that are parallel to the side edges 124, 125 of the side wall panel 110. Further, each side cell divider panel 163, 164 is provided with a glue flap 169, 170 also cut out of that cell divider panel section 156 (note cut lines 155). Cell divider panel section 157 is comprised of cell divider panels 154, 171 (note cut lines 145), these panels being foldably connected to the panel sections 157 along fold lines 172, 173, respectively. Each cell divider panel 154, 171 is provided with a glue flap 174, 175, respectively, (note cut lines 144), that is foldably connected thereto. As shown in FIG. 8 the cell divider panel section 157, when the carrier blank 109 is in the as-cut configuration shown in that figure, crosses the center line of the blank which is defined by fold line 120, 121 of the handle panels 114, 115 and the handle reinforcing panels 116, 117. The cell compliance panel section section 158, which serves the side wall panel 110, is comprised of cell compliance panel 177 and cell compliance panel 178, these panels being cut from the section 158 along cut lines 176, and foldably connected thereto along fold lines 179, 180, respectively. The other cell compliance panel section 159 is comprised of cell compliance panels 181, 182, which are cut from the section 159 along cut lines 185, and which are foldably connected thereto by fold lines 183, 184, respectively. Therefore, and in this carrier blank 109 configuration, note that the cell divider panel sections 156, 157, and the cell compliance sections 158, 159, with all the respective cell divider panels and cell compliance panels therewithin, extend from opposite side edges 124, 128 and 125, 129 of the side wall panels 110, 111 where the top edges 112, 113 of those side wall panels are parallel to but spaced from one another.

Figure 9:
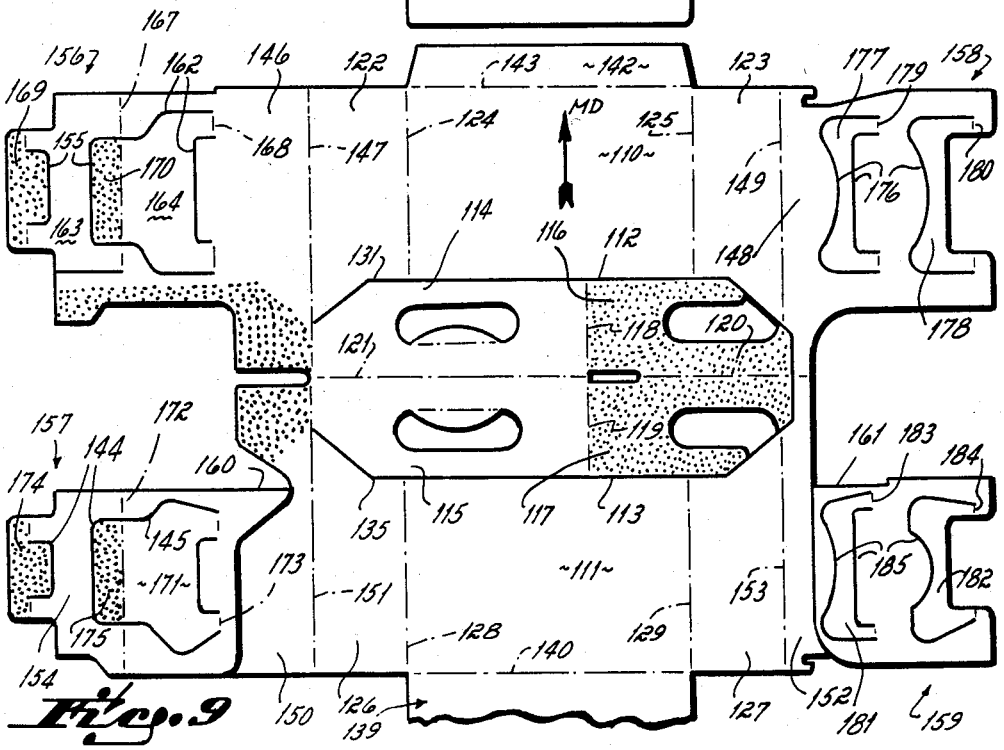
FIG. 9 is a view similar to FIG. 8 showing one set of the blank's cell divider panel and cell compliance panel sections folded and glued to handle panel sections in a first intermediate assembly step.
Figures 10, 11, 12:
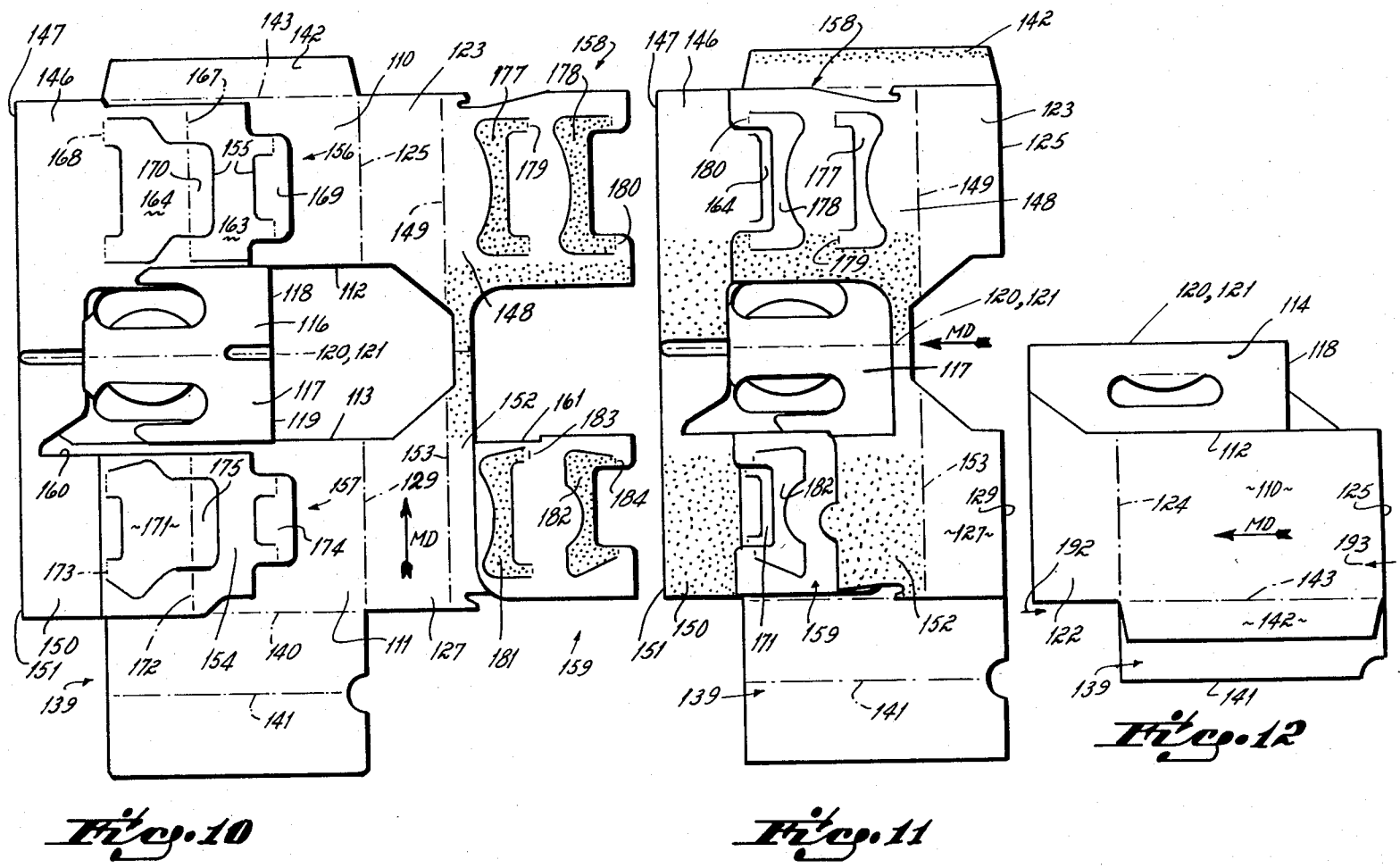
FIG. 10 is a view similar to FIG. 9 showing the blank's cell divider panel sections, side wall panels and handle blank's cell divider panel sections, side wall panels and handle panel sections folded and glued in a second intermediate assembly step.
FIG. 11 is a view similar to FIG. 10 showing a third intermediate assembly step for the second carrier blank.
FIG. 12 is a view similar to FIG. 11 but showing the finally assembled carrier from the FIG. 8 carrier blank, the compliance carrier being shown in the knock-down configuration.

The folding and gluing sequence, i.e., the assembly sequence, of the carrier blank 109 into fabricated but knock-down configuration is illustrated in FIGS. 8–12. This assembly sequence is carried out in a carton gluing machine known as a right-angle gluing machine in which the carrier blank 109 proceeds initially through the machine in one direction, and without being rotated is thereafter caused to move through the machine after an intermediate point in a direction at right angles to the initial travel path. The initial travel path direction of the carrier blank 109 through a carton gluing machine is shown by the machine direction arrow MD in FIG. 8. Note in this regard that the carrier blank 109 initially proceeds through the gluing machine in a direction parallel to the side edges 124, 125 and 128, 129 of the side wall panels 110, 111, respectively. With the carrier blank 109 in the as-cut configuration shown in FIG. 8, glue (as shown by the stippled areas) is provided to the non-sidewall aligned cell divider panel sections 157 and to cell compliance panel section 159 as shown in that figure. With the carrier blank 109 proceeding through the gluing machine in the machine direction shown by arrow MD, the one pair of cell divider panel 157 and cell compliance panel 159 sections is folded back along fold lines 160, 161 so that those sections are glued to keel panels 150, 152, respectively, in that structural configuration shown in the first intermediate assembly step of FIG. 9. This folding back and gluing step aligns the cell divider panel section 157 and the cell compliance panel section 159 with the side wall panel 111, the cell divider panel section 156 and cell compliance panel section 158 already being aligned with side wall panel 110 and not requiring any folding back step. In the first intermediate assembly position shown in FIG. 9, the glue flaps 169, 170 and 174, 175 of the cell divider panel sections 156, 157, respectively, are provided with glue as shown in the stippled areas. Further, the handle areas of keel panels 146, 150, and the handle reinforcing panels 116, 117, are also provided with glue as shown by the stippled areas of FIG. 9. With the carrier blank 109 as shown in FIG. 9 moving in the machine direction shown by arrow MD, the cell divider panel sections 156, 157 are then folded along fold lines 147, 151 onto the side wall panels 110 and 111, respectively. This glues the cell divider panels 163, 164 and 154, 171 to the side wall panels 110, 111, respectively, and also glues the keel panels 146, 150 at one end of the carrier to the handle panels 114, 115. Thereafter, the handle reinforcing panels 116, 117 are folded along fold lines 118, 119 into glued relation with the handle panels 114, 115, also as shown in FIG. 9. The results of this folding and gluing step is a second intermediate assembly position illustrated in FIG. 10, and now sets the stage for the folding and gluing of the cell compliance panel sections 158, 159 with the cell divider panel sections 158, 159 with the cell divider panel sections 156, 157. In the FIG. 10 or second intermediate attitude shown, the cell compliance panel sections 158, 159 are provided with glue as shown by the stippled areas. Further, the handle area of each of the keel panels 148, 152 is provided with glue as also shown by the stipped areas. This gluing application is accomplished after the machine direction of the blank shown in FIG. 10 has been changed to a machine direction (shown by arrow MD in FIG. 11) which is parallel to the top edges 112, 113 of the side wall panels 110, 111. With glue applied, the cell compliance panel sections 158, 159, and end wall panels 123, 127, are then folded along fold lines 125, 129 onto the cell divider panel sections 156, 157 for the purpose of gluing the cell compliance panels 117, 178, and 181, 182 with related cell divider panels 163, 164 and 154, 171. Therefore, the folding and gluing step of the cell compliance panel sections 158, 159 with the cell divider panel sections 156, 157 is provided by a simple fold about a leading fold line 125, 129 that is perpendicular to the machine direction MD of the partially assembled blank through the carton gluing machine, compare the FIG. 10 position to the FIG. 11 position. In this blank 109 embodiment, therefore, note it is the cell compliance panel sections 158, 159 that are folded perpendicular to the machine direction MD of the blank through the gluing machine in order to glue the cell compliance panels to the pre-positioned cell divider panels in the cell divider panel sections 156, 157. Further, note that all cell compliance panels are glued to all cell divider panels simultaneously with gluing the blank into a carton configuration which defines the cell rows 190, 191 that have side walls 110, 111 and end walls 122, 126 and 123, 127 in glued configuration. In this particular blank 109 structure, one fold is required (namely, a fold about fold line 147) to position the cell divider panel section 156 relative to the cell compliance panel section 158, two folds are required (namely, a fold about fold line 160 and a fold about fold line 151) to position the cell divider panel section 157 with the cell compliance panel 159, and one fold is required (namely, a fold about fold line 161) to position the cell compliance panel section relative to the cell divider panel section 157, prior to folding and gluing the cell compliance panel sections 158, 159 into assembled relation with the cell divider panel sections 156, 157. However, the most relevant fold, namely, the fold of the cell compliance panel sections 158, 159 into assembled and glued relation with the cell divider panel sections 156, 157, is a simple fold transverse to the machine direction of the blank at the time of that fold along fold line 125, 129. Important, also, is the fact that there is no folding back of any cell divider panel or cell compliance panel or glue flap within any of the respective panel sections 156–159 prior to folding and gluing of those sections into assembled relation as shown in FIG. 11. This is the case even though preliminary positioning is required for one set of the cell divider 157 and cell compliance 159 panel sections relative to side wall panel 111, and even though preliminary positioning is required for the cell divider panel sections 156, 157 on fold line 147, 151 relative to the side wall panels 110, 111.

With the carrier blank in the third intermediate folded and glued position shown in FIG. 11, glue is applied to flor glue flap 142, and to keel panels 146, 148, 150 and 152, as shown by the stippled areas in that figure. Subsequently, and with the carton blank 109 following the machine direction as shown by arrow MD through the gluing machine, the top half of the carton is folded along fold line 121, 120 onto the bottom half of the carton, with the floor panel 139 being prefolded along fold line 141, to provide the final assembled but knock-down carrier 108 configured as shown in FIG. 12.

The second compliance carrier 108 in accord with the principles of this invention is erected from the knock-down configuration shown in FIG. 12 through exerting force on opposite end edges thereof along force lines 192, 193. This results in a carrier 108 set-up or erected as shown in FIG. 7 with suitable double paperboard thickness being provided in the heel area 194 and shoulder area 195 of the cell divider panels for each row 190, 191 of cells.

Having described in detail the preferred embodiment of our invention, what we desire to claim and protect by Letters Patent is:

1. A method of erecting a carrier blank into a basket type compliance carrier, said method comprising the steps of providing a carrier blank having side wall panels, end wall panels, and a floor panel, two cell divider panel sections, each of said divider sections comprising at least two cell divider panels, the cell divider panels of each divider section cooperating with one side wall panel to provide a row of cells when said carrier is assembled and erected, thereby providing two side-by-side cell rows, and two cell compliance panel sections, each of said compliance sections comprising at least two cell compliance panels, the cell compliance panels of each compliance section cooperating with one cell divider panel section to provide a double thickness in the heel and shoulder areas of the cell divider panels of adjacent cells, and passing said blank through a gluing machine in a machine direction for assembly into a knock-down carrier structure from said carrier blank structure, said cell divider panels and cell compliance panels within each associated pair of cell divider and cell compliance panel sections being glued one to the other in double thickness form upon folding one section in a cross machine direction relative to the other section without folding back of any glue tabs or panels within any of said sections.

2. A method as set forth in claim 1, said method comprising the step of folding said cell divider panel section and said cell compliance panel section associated with each side wall panel on a leading fold line relative to the machine direction travel of said carrier blank through said gluing machine, both pairs of said cell divider and cell compliance panel sections associated with each side wall panel being folded and glued simultaneously.

3. A method as set forth in claim 1, said cell divider panel section and said cell compliance panel section for each cell row extending outboard from the same side of said sections' associated side wall panel.

4. A method as set forth in claim 1, said cell divider panel section and said cell compliance panel section associated with each cell row extending outboard from opposite side edges of said sections' associated side wall panel.

5. A method as set forth in claim 1, said method comprising the step of folding said cell divider panel sections on a fold line perpendicular to the machine direction of said blank through said gluing machine for gluing all compliance panels within said cell compliance panel sections to all cell divider panels within said cell divider panel sections.

6. A method as set forth in claim 1, said method comprising the step of folding said cell compliance panel sections on a fold line perpendicular to the machine direction of said blank through said gluing machine for gluing all cell divider panels within said cell divider panel sections to all cell compliance panels within said cell compliance panel sections.

7. A method as set forth in claim 1, said method comprising the step of gluing all cell divider panels within each cell divider panel section to all cell compliance panels within each cell compliance panel section prior to folding and gluing said blank into carrier configuration.

8. A method as set forth in claim 1, said method comprising the step of gluing all said cell divider panels within said cell divider panel sections to all said cell compliance panels within said cell compliance panel sections simultaneously with gluing of said blank into carrier configuration.

9. A method as set forth in claim 8, said sections being arranged so that one cell divider panel section and its associated cell compliance panel section are folded to properly position same relative to said sections' associated side wall panel before folding and gluing of said sections relative one to the other.

* * * * *